US005259496A

United States Patent [19]

Common

[11] Patent Number: 5,259,496

[45] Date of Patent: Nov. 9, 1993

[54] BELT FOR CONVERSION PRESS

[75] Inventor: Steven P. Common, Oakwood, Ohio

[73] Assignee: Dayton Reliable Tool & Mfg. Co., Dayton, Ohio

[21] Appl. No.: 971,323

[22] Filed: Nov. 4, 1992

Related U.S. Application Data

[63] Continuation of Ser. No. 656,671, Feb. 19, 1991, abandoned.

[51] Int. Cl.[5] ..... B65G 17/34

[52] U.S. Cl. ..... 198/803.15; 198/844.2; 72/426; 413/66; 228/160; 228/5.7

[58] Field of Search ..... 198/803.14, 803.15, 198/844.2; 72/419, 426; 413/45, 47, 52, 66; 228/5.7, 160

[56] References Cited

U.S. PATENT DOCUMENTS

| | | | |
|---|---|---|---|
| Re. 33,061 | 9/1989 | Brown | 413/66 |
| 3,308,698 | 3/1967 | Brown | 228/160 |
| 4,597,521 | 7/1986 | Wilson | 228/5.7 |
| 5,037,024 | 8/1991 | Minato et al. | 228/160 |

*Primary Examiner*—Joseph E. Valenza

[57] ABSTRACT

A conveyor belt and drive structure are disclosed for use with a conversion press in which an upper level of an endless metallic conveyor belt, preferably of stainless steel, is positioned between upper and lower tooling in the press. The conveyor belt is formed by seam welding together the ends of a length of thin flexible metal, and includes a plurality of transversely and longitudinally spaced shell-receiving carrier apertures. The edges of the conveyor belt at the ends of the weld seam are relieved with an elongated notch shape having corners formed on a radius to eliminate from the belt stress concentrations which may occur during the welding process.

5 Claims, 4 Drawing Sheets

BELT FOR CONVERSION PRESS

RELATED APPLICATION

This application is a continuation of application Ser. No. 07/656,671 filed 19 Feb. 1991 now abandoned.

BACKGROUND OF THE INVENTION

This invention relates to a mechanical press used to convert shells into ends for self-opening cans and the like and, more particularly, to a belt and belt drive for conveying the shells through such a conversion press.

Various beverages, as well as many foods, are packaged in cans formed from aluminum or coated steel. The can body is manufactured by several known methods to include sidewalls, a bottom, a top to which an end is attached after the body is filled. The upper end or top, which may include means by which the can is later opened, is of course manufactured separately. These self-opening ends are made from a shell (the principal component of the end) which is subsequently converted to an end by appropriate scoring and attachment of a tab by known integral riveting techniques.

U.S. Pat. No. Re. 33,061 assigned to the assignee of this application, discloses a typical conversion press for scoring shells and attaching tabs thereto. This press includes a conveyor belt which extends from one side of the press to the other through in-line conversion tooling. Cooperating with the conveyor are upstacker and downstacker mechanisms located on either side of the slide, to supply shells to and remove shells from the conveyor belt. In some applications upstackers may not be used, rather the ends may be discharged from the end of the conveyor belt. The shells are received in circular apertures in the conveyor belt, which is moved stepwise through the press in synchronism with the opening and closing of the tooling.

As shown in FIGS. 3, 6 and 10 of U.S. Pat. No. Re. 33,061 a strip for forming tabs to be attached to the shells is conveyed across the path of the shells in the conveyor belt. The tab strip is conveyed through the press in a generally front to rear direction and tabs are formed in the tab strip as it is conveyed through tab forming stations within the press, while the shells are conveyed simultaneously to successive tooling stations where various forming and scoring operations are performed. The tab strip and shells meet at a tab attachment station where the completed tabs are transferred from the tab strip to the shells to form completed can ends.

In commercial versions of such conversion presses a thin flexible metal conveyor belt, usually made of stainless steel, is often used, and has been provided with a plurality of sprocket holes extending in a longitudinal direction along the conveyor belt. In commercial versions of such presses two or more lanes of shell-receiving apertures or pockets are provided, with the pockets in each lane offset lengthwise of the belt from those pockets in the adjacent lane. This spatial relationship is dictated by the size of the ends and the geometry of the several lanes of tooling in the press, it being understood that the center-to-center distance along each lane between the pockets is the same, and equals the distance the conveyor belt must advance between successive closures of the tooling, to locate the shells concentrically between the successive tooling stations.

A drive drum supporting the conveyor belt at one end thereof has been provided with a plurality of sprocket teeth for engaging in like shaped sprocket holes formed in the belt, thereby to provide positive engagement between the drive drum and the belt for accurately displacing the shells in their intermittent movement through the press.

Conversion presses of this type will have design speeds in the order of 400 to 600 strokes/minute, sometimes even higher. The power for the conveyor drive is usually derived via a power take-off mechanism from the main press drive, wherein one revolution of the main drive is translated into a single stroke of the press tooling. This mechanism is commonly called an "intermitter." To avoid interference between conveyor belt motion and the closing-opening action of the tooling, indexing (incremental advancing) of the conveyor belt is generally confined to about 210 degrees of crankshaft rotation, leaving a dwell of 150 degrees in the conveyor drive, divided around bottom dead center of crank rotation. Thus in a typical beer/beverage conversion press this calls for an indexing motion of the conveyor belt in the order of 3 inches (76.2 mm.), and at a press speed of 600 rev./min. the complete indexing motion must occur in approximately 0.06 seconds. It follows that the forces required to accelerate and decelerate the conveyor system are substantial, and there is considerable stress in the belt.

As a result of these forces being transmitted from the sprocket teeth on the drive drum to the edges of the rectangular sprocket holes in the conveyor belt, stress failures, e.g. cracking occurring at the location of the sprocket holes, have been encountered. When such a failure occurs in a conveyor belt, the press must stop, the belt is cut and removed from the press, then a new belt installed and then welded (in the case of the steel belt) into an endless loop, and the belt drive tightened. The matter of avoiding such stress concentrations by use of a unique pin drive between the drive drum and belt is disclosed in copending U.S. patent application Ser. No. 561,996 filed 26 Jul. 1990.

The metal, usually stainless steel, belts are replaced by cutting completely across the failed belt, removing it from the press, attaching a welding fixture and small arc welder to the press, threading a new belt through the tooling and around the drive and idlers drums, clamping the ends of the new belt in the fixture, then welding the ends of the belt. Suitable mounts are fitted to the press to accommodate such welding fixture, and it in turn provides support for the welder, usually a TIG (tungsten-inert gas) welder of known design. The fixture and welder are readily fitted temporarily to the press and the weld seam completed to provide a the requisite endless belt configuration.

In the process of welding the belts, particularly stainless steel material, it has been found that stress risers are created at the beginning and end of the welded seam, and these lead to stress concentrations in those areas and resultant belt failures. Therefore, it is important to minimize the stress concentrations resulting from such welding process.

SUMMARY OF THE INVENTION

The present invention provides a conveyor belt and conveyor drive system for use with a conversion press as generally described above, in which an upper level of an endless thin flexible metallic conveyor belt is positioned between upper and lower tooling in the press, and has a plurality of transversely and longitudinally spaced shell-receiving carrier apertures or pockets which carry shells from station to station of the tooling, stopping progressively between the sequence of tooling stations.

In a preferred embodiment of the invention, the belt is of stainless steel, and after welding of the seam to form an endless belt, those portions of the belt at the ends of the weld seam are notched or cut away to rid the belt of the stress concentrations created during welding. The location and design of this notch is important to alleviate stress risers, and not create additional ones, at the ends of the weld seam. The notch is elongated in the direction lengthwise of the belt, has an inner edge spaced in the order of 0.250 to 0.375 inch from the belt edge, and includes corners formed on a predetermined radius.

Accordingly, the principal object of the invention is to provide a belt conveyor drive system for a can end conversion press, or the like, which will have an extended life so as to minimize press down time to replace a damaged conveyor belt; to provide such a system which is particularly directed to an improved arrangement using a thin flexible metal conveyor belt which has ends welded together to make an endless loop, and wherein the edges of the belt at ends of the weld seam are notched at the ends of the weld seam, to eliminate areas of stress concentration; and to provide a method of making an improved endless flexible metal conveyor belt in which stress risers are minimized to extend the useful life of such belt.

Other objects and advantages of the invention will be apparent from the following description, the accompanying drawings and the appended claims.

DETAILED DESCRIPTION OF THE PREFERRED EMBODIMENT

Figure 1:
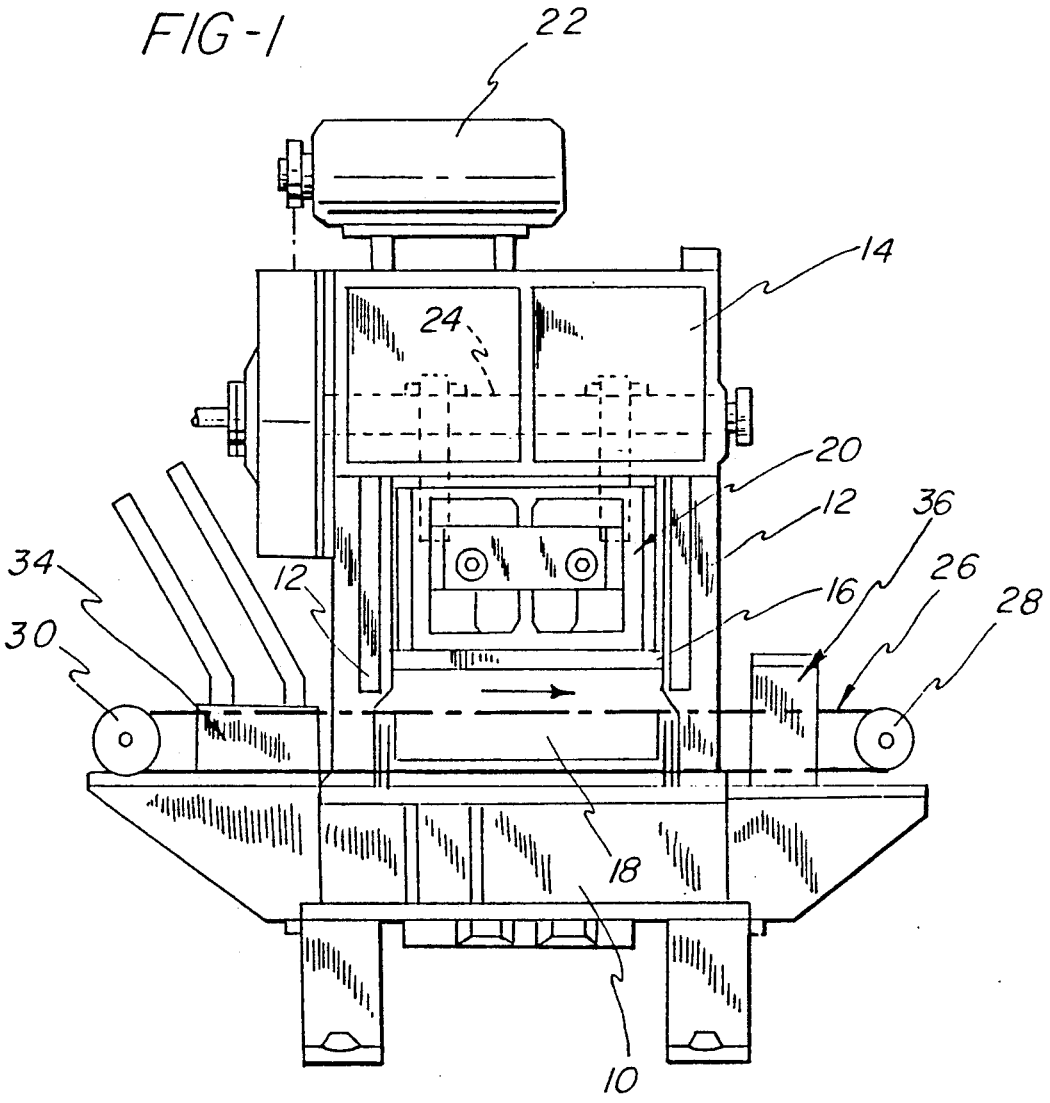
FIG. 1 is a front overall view of a press using the conveyor belt and drive system of the present invention.

The outline and lay-out of a typical press in which the conveyor belt and drive system of the present invention may be used is shown in FIG. 1 and may be any typical single acting press. The press includes a bed 10, uprights 12 and a crown 14 supported on the uprights 12. An upper tooling set, indicated by the general reference numeral 16, is mounted on a press slide 20 which is supported from the crown 14 for reciprocating movement toward and away from a lower tooling set, indicated by the general reference numeral 18, supported on the bed 10. A motor 22 is supported on the top of the crown 14 for driving the slide 20 in its reciprocating motion through a crank 24 in a well known manner substantially as disclosed in commonly assigned U.S. Pat. No. Re. 33,061 the disclosure of which is incorporated herein by reference.

The press further includes a conveyor belt 26 which is preferably formed as an endless belt of relatively flexible material such as thin stainless steel. The conveyor belt 26 is driven by a drive drum 28 located on one side of the press and is supported at an opposite end of the belt 26 by an idler or follower drum 30. The drive drum 28 is connected to the crank 24 through a standard intermittent drive mechanism (not shown) such that belt 26 is intermittently advanced in steps synchronized with the movement of the slide 20.

By locating drive holes 40 between the placement of apertures 32, the holes 40 are strategically positioned in regions where an optimum area of belt material surrounds each hole 40 to minimize the creation of higher stress points in the belt 26. The stress in the belt 26 is further minimized by positioning the holes 40 along oblique lines so no two holes 40 lie on a normal line transverse of the belt 26, thus avoiding propagation of stresses directly across the belt between holes 40 as the belt 26 flexes transversely as it passes around the drive and idler drums.

Figure 3:
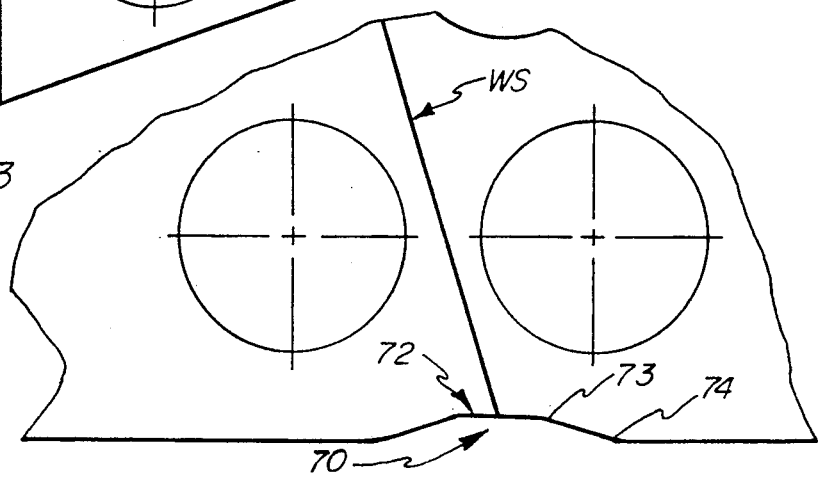
FIG. 3 is an enlargement of one end of the weld seam shown in FIG. 2.

As may be seen in FIG. 3, the drive drum 28 includes drive pins 42 for engaging within the drive holes 40 of conveyor belt 26. The drive pins 42 are preferably arranged in first and second circumferential rows around the drive drum 28 with each row containing four pins 42 spaced at intervals of 90° around the drum 28. The pins in the first row are angularly displaced about the circumference of the drive drum 28 relative to the pins 42 in the second row such that the pins 42 in the first and second rows of pins 42 are aligned transversely across the face of the drive drum 28 at an oblique angle relative to the rotational axis of the drum 28. Thus, the pins 42 are positioned about the circumference of the drum 28 in locations which match the array of drive holes 40 in the conveyor belts 26.

Figure 2:
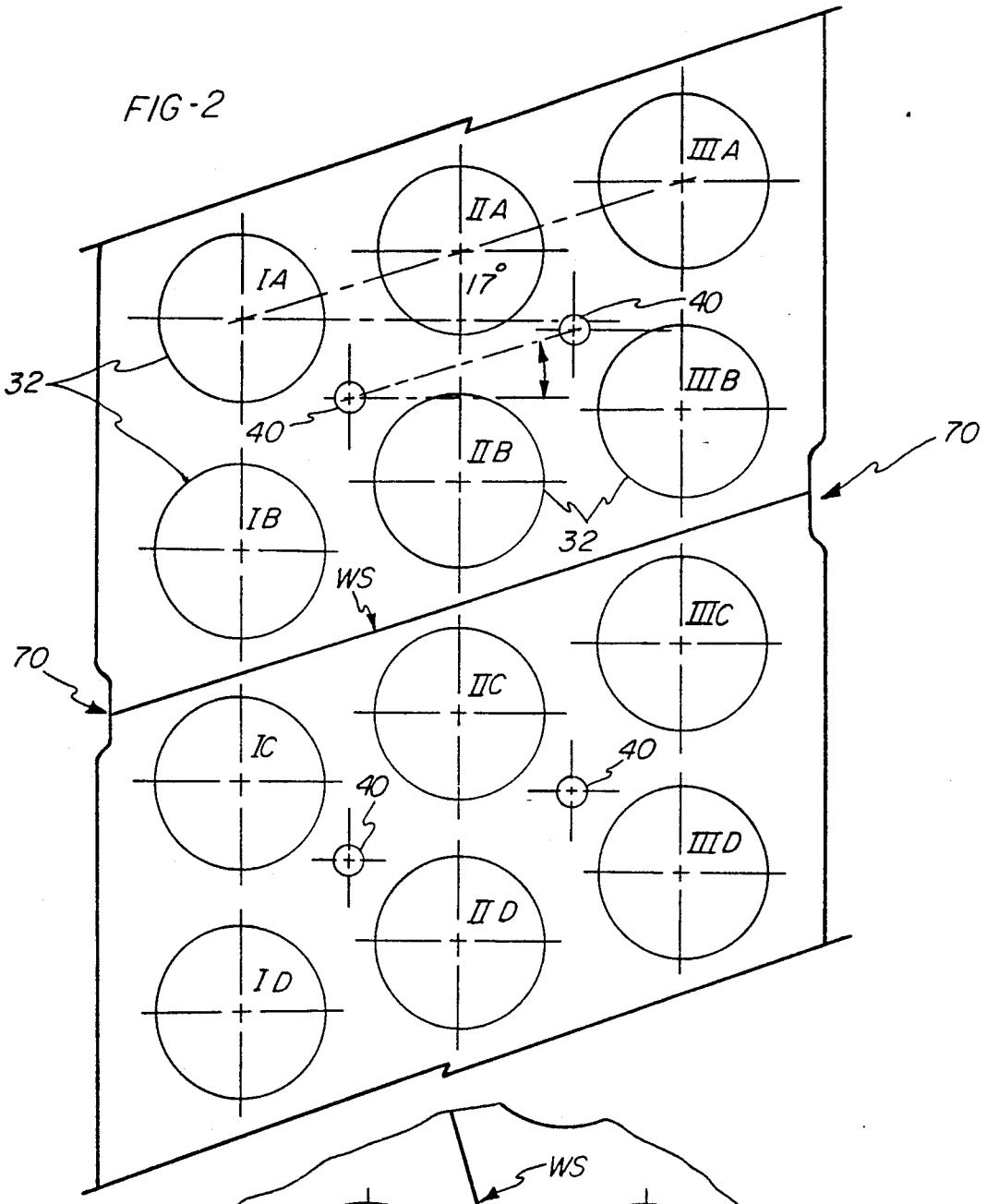
FIG. 2 is a plan view of a section of the conveyor belt of the present invention.

As seen in FIG. 2, belt 26 includes a plurality of substantially circular apertures or pockets 32 for receiving and carrying shells through the press. The apertures 32 are of such a diameter that the lip portion of a shell located therein overhangs the edge defining the aperture opening. The apertures 32 are arranged along the belt in longitudinally extending lanes (for example three lanes are shown in FIG. 2), designated as I, II and III.

As belt 26 is intermittently advanced through the press, shells are loaded onto the conveyor belt 26 by a downstacker indicated by reference numeral 34 and the converted ends may be removed from the conveyor belt 26 by an upstacker indicated by reference numeral 36 at an opposite side of the press. Optionally, the upstacker may be eliminated, and the ends dropped off the end of belt 26 onto a conveyor or the like as the belt passes around drive drum 28. The downstacker 34 and upstacker 36 may be similar in structure and operation to the loading and unloading mechanisms shown in FIGS. 13 through 18 of U.S. Pat. No. Re. 33,061.

The upper and lower tooling 16, 18 are provided for forming and scoring the shells and attaching tabs to the shells as they pass between the bed 10 and slide 20 of the press. In addition, tooling is usually provided within the press for forming tabs for attachment to the shells from a strip of stock material passing in a front to rear direction through the press, transverse to the longitudinal direction of the conveyor belt 26. A full description of the necessary tooling for forming the scoring on the shells, and for producing and attaching the tabs to the shells, may be found in the above referenced U.S. Pat. No. Re. 33,061. It should be noted that although the tooling disclosed therein is designed to operate on only two longitudinally extending lanes of shells carried by the conveyor belt (as is the embodiment later described herein), the provision of additional tooling to operate in cooperation with a conveyor belt having more than two lanes of shell apertures, is within the skill of the artisan in the can end making art, and in reality depends on the capacity of the press, the size of the ends to be converted, and the opening tab application.

Referring to FIG. 2 in which a section of a three lane belt is shown in plan view, it can be seen that the apertures 32 are arranged in regularly spaced relationship within lanes designated I, II and III, and the lanes are regularly spaced from each other in the transverse direction of the belt 26. The center-to-center spacing of apertures along the lanes equals the center-to-center distance of the progressive tooling stations, thus one increment of belt motion moves a shell from one tooling station to the next in a stepping motion.

The center-to-center spacing of the lanes is selected to correspond to the indexing motion of the tab tooling, so the strip of tabs can stop, properly aligned, over a shell in each lane at the tab transfer/stake stations. As a result, apertures 32 are aligned with each other in a direction transverse to the longitudinal direction of the lanes I, II and III, and path of motion of the belt 26 such that the apertures 32 define oblique rows, designated A, B, C, D, across the width of the belt 26. Further, the lanes of apertures 32 are staggered relative to each other in the longitudinal direction of the belt such that the aperture rows A, B, C, etc. are aligned at an oblique angle relative to a normal line transverse to the belt center line.

As will be apparent, the longitudinal location of apertures 32 is selected in accordance with the station placement of the tooling, and is such that a tab strip may be conveyed transversely over the belt 26 at the transfer/-stake stations, and each incremental advancement of the belt 26 will position an entire one of the rows A, B, C, . . . in overlapping relationship with the tab strip, whereby tabs carried by the strip may be simultaneously attached to the shells positioned in one row.

Conveyor belt 26, as described in more detail in said copending application Ser. No. 561,996, includes circular drive holes 40 extending in first and second longitudinal lanes. One lane of holes 40 is located equidistant from each of carrier aperture lanes I and II, and the other lane of holes 40 is located equidistant from each of carrier aperture lanes II and III. The drive holes 40 are uniformly spaced apart and are spaced apart a distance at least as great as the center-to-center distance between adjacent carrier apertures 32.

Figure 4:
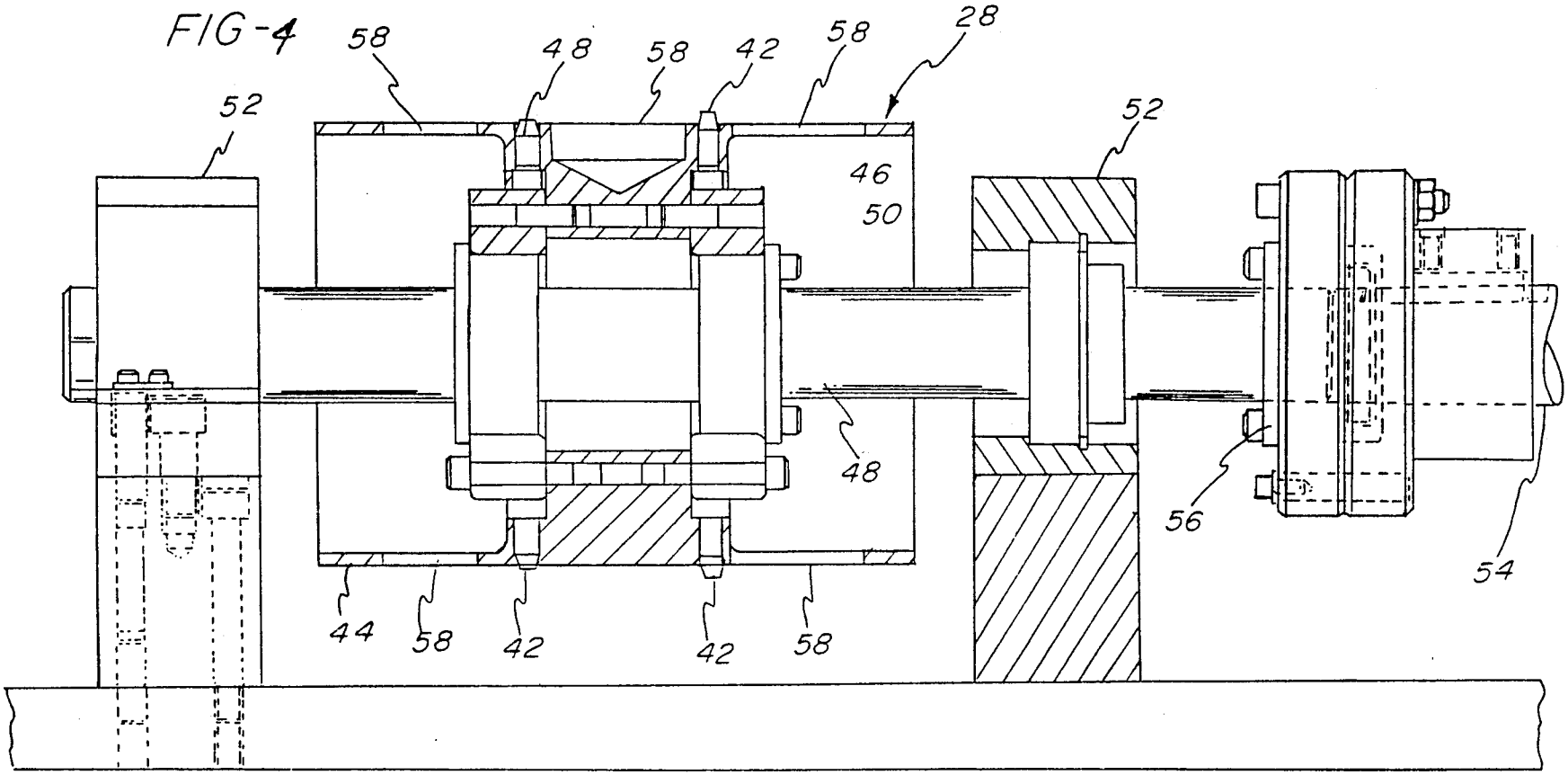
FIG. 4 is a section view taken longitudinally of the drive drum.
Figure 5:
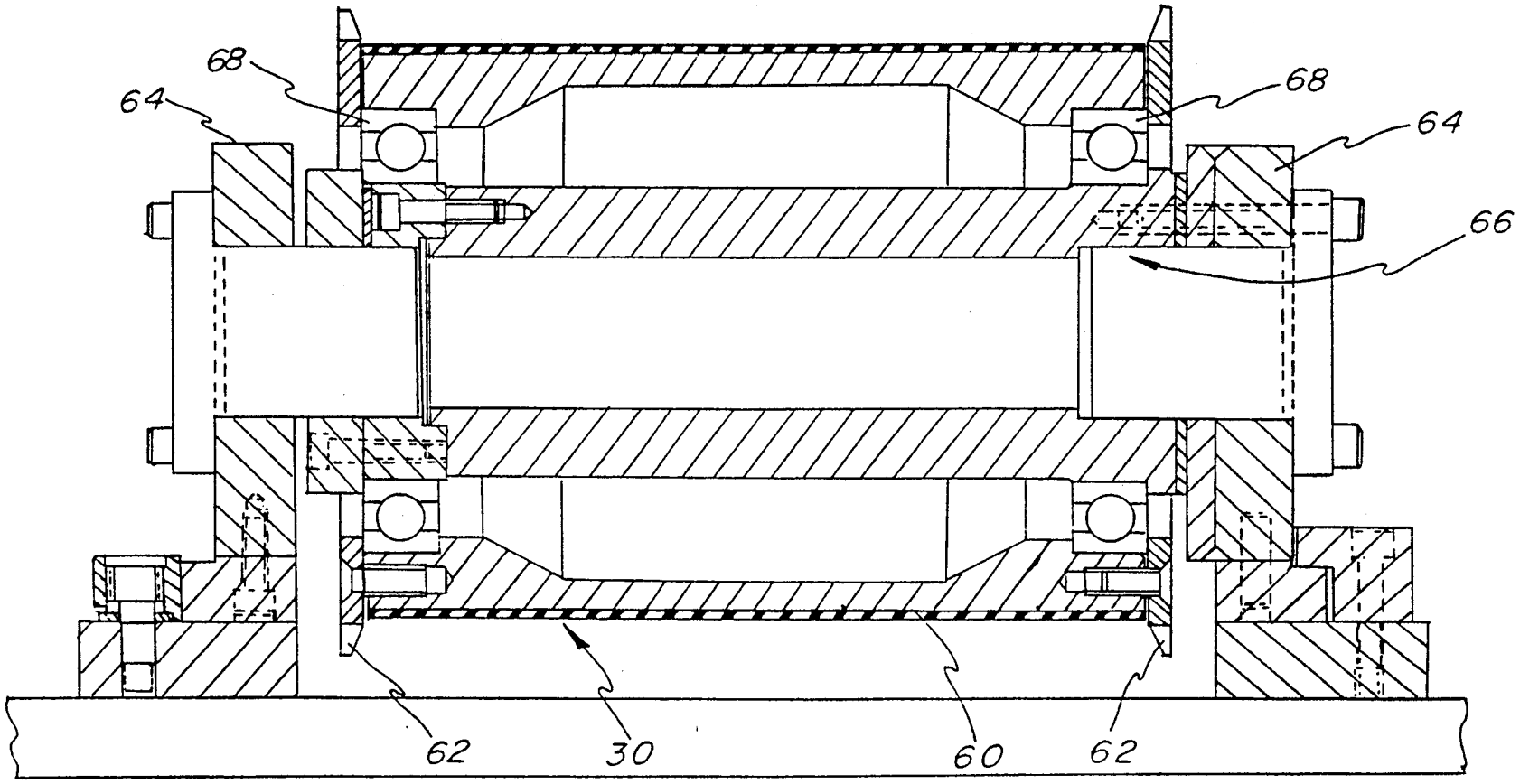
FIG. 5 is a cross-section view taken longitudinally of the follower drum and its supporting structure, with the support shaft shown in elevation.

Drive drum 28 (FIG. 3) includes an outer rim 44 which contacts and supports the conveyor belt 26 and a hub portion 46 which is connected to a drive shaft 48 by means of a conventional coupling 50. The drive shaft 48 is supported for rotation by a pair of supports 52 (with appropriate bearings) located on either side of the drive drum 28 and is connected through a conventional coupling 56 to output shaft 54 of a conventional intermittent right-angle drive. The drive train ratio from the press drive through the intermitter, together with the diameter of the drive drum, are selected such that one complete revolution of the press crankshaft produces a predetermined fraction of a revolution of drum 28 which in turn produces a linear displacement or feed motion of belt 26 to the longitudinal center-to-center spacing of apertures in the same lane. In the embodiment illustrated in FIGS. 3 and 4, this results in one-eighth revolution of drive drum 28 for each crankshaft revolution.

A follower drum 30 (FIG. 4) supports the conveyor belt 26 at the opposite end from the drive drum 28 and includes an outer rubber facing 60 for contacting and supporting the conveyor belt 26 and end caps 62 located on either end of the follower drum 30. The end caps 62 are provided with radially extending sides which are angled inwardly toward the center of the follower drum 30 in order to facilitate locating the conveyor belt 26 on the rubber facing 60 of the follower drum 30. The follower drum 30 is supported for rotation by conventional support members 64 located on either side of the drum 30 which support a hub assembly 66 including bearings 68 for rotatably mounting the drum 30. Thus, the upper flight of belt 26 extends through and between the upper and lower tooling in the press.

Referring to FIG. 2, the weld seam WS extends obliquely of the belt, to traverse the region of maximum belt area between rows of carrier apertures 32 and feed holes 40. In practice, a fixture (not shown) is temporarily supported on the press to one side of the tooling, and includes pins corresponding in size to pins 42 which register one end of the flexible metal belt material to a guideway which defines the path of a TIG welding head. The other end of the belt material is registered and clamped into the other side of the fixture. The welder is then operated to make an autogenous weld of the mated ends of the belt material. The resulting weld seam WS is in the order of 0.090 to 0.100 inch in width.

It has been observed that in such a weld seam there are burnout areas at the beginning and end of the weld seam WS, and that as a result there are stress risers extending outward irregularly from such burnout areas. It is the purpose of the invention to expunge these stress risers from the weld seam region, while avoiding the creation of further stress risers as a result of this action. For example, formation of V-shaped and/or half-circle shaped notches has been tried, and while these may minimize or remove some or all of the stress risers due to the weld, they create further stress rises themselves. Thus, there is no net improvement using such V-shaped or half-round notches.

According to the invention, after the weld is formed, notches 70 are formed in the edges of belt 26 at the beginning and end of the weld seam WS. These notches have an inner edge 72 which extends parallel to the belt edge and spaced inward therefrom. The inner and outer ends 73 and 74 of notches 70 are formed as radii to make a smooth transition between the notch and the belt edge.

In a successful embodiment using stainless steel belt materials of 0.015 and 0.020 inch thickness, the notch inner edge 72 is located inward from the belt edge about 0.375 inch, the inner notch ends are formed on a 1.000 inch radius, and the outer notch ends are formed on a radius of 2.000 inch. The notch extends at its outer ends about 3.44 inches, and at its inner end about 0.500 inch, generally centered on the weld seam. These measurements are not critical, but are given by way of a typical example.

While the method herein described, and the conveyor belt made by this method, constitute preferred embodiments of this invention, it is to be understood that the invention is not limited to this precise method and type of flexible metal conveyor belt, and that changes may be made in either without departing from the scope of the invention, which is defined in the appended claims.

What is claimed is:

1. In a press for performing operations on shells for can ends and the like, said press having a bed and a slide, drive means connected to said slide to reciprocate said slide toward and away from said bed, upper and lower tooling supported on said slide and said bed, respectively, to perform operations on shells conveyed through said press between said tooling, an endless metallic conveyor belt formed of a length of thin flexible metal having its ends joined along a weld seam and providing an upper flight thereof positioned between said upper and lower tooling and a lower flight separated from said tooling, said conveyor belt including a plurality of transversely and longitudinally spaced shell carrier apertures arranged in parallel lanes along said conveyor belt and means connecting said conveyor belt to said drive means for intermittent movement thereof, whereby said conveyor belt may intermittently convey shells between said tooling;

the improvement comprising said belt having means for relieving belt stress concentrations due to imperfections at the end of the welded seams in the belt, the stress relieving means including notches formed along the edges of the belt at the ends of the weld seam, said notches being of greater length along the edge of the belt than depth inward from the edge of the belt, said notches having rounded corners at the edge of the belt and at the interior of the notches.

2. An endless flexible metal conveyor belt for a can end conversion press or the like, said conveyor belt formed of a length of thin flexible metal having its ends joined along a weld seam and being adapted to be guided and driven in a horizontally elongated loop which has an upper flight positioned between tooling in the press;

said belt having notches formed in the sides thereof at the ends of the weld seam to eliminate from the belt stress concentration areas due to the welding of the seam, said notches being elongated to have greater length along the edge of the belt than depth inward from the edge of the belt, said notches having rounded corners at the edge of the belt and at the interior of the notches.

3. A method of forming an improved conveyor belt for a press for performing operations on shells for can ends and the like, the press having a set of cooperating progressive tooling supported on the press slide and bed, respectively, to close and open in performing a succession of operations on shells conveyed through the press, and an endless metal conveyor belt having a joint in the form of a weld seam and having an upper flight thereof positioned between the tooling, the belt having a plurality of transversely and longitudinally spaced shell receiving carrier apertures arranged in parallel lanes thereon; said method comprising forming a length of thin flexible metal into and endless belt by welding together the ends of such length; and forming notches in the sides of the belt at the ends of the weld seam to eliminate from the belt stress concentration areas at the ends of the weld seam resulting from the welding process, said notches being elongated to have greater length along the edge of the belt than depth inward from the edge of the belt, said notches having rounded corners at the edge of the belt and at the interior of the notches.

4. The method defined in claim 3, wherein said belt material is stainless steel and the weld is an autogenous weld, and wherein the notches are formed with rounded corners to avoid stress risers around the edes of the notches.

5. A belt as defined in claim 2, wherein the weld seam extends obliquely relative to the longitudinal direction of the belt.

* * * * *